US008038020B2

(12) United States Patent
Vecchio et al.

(10) Patent No.: US 8,038,020 B2
(45) Date of Patent: Oct. 18, 2011

(54) SUPPORT FOR A SET OF TOOLS

(75) Inventors: Jocelyne Vecchio, Vitry sur Seine (FR); Hadi Idir, Sevran (FR); Christian Charon, Montreuil (FR); Benoît Tillet, Paris (FR)

(73) Assignee: FACOM, Morangis (FR)

( * ) Notice: Subject to any disclaimer, the term of this patent is extended or adjusted under 35 U.S.C. 154(b) by 0 days.

(21) Appl. No.: 12/308,867

(22) PCT Filed: Jun. 11, 2007

(86) PCT No.: PCT/FR2007/000958

§ 371 (c)(1),
(2), (4) Date: Sep. 14, 2009

(87) PCT Pub. No.: WO2008/000925

PCT Pub. Date: Jan. 3, 2008

(65) Prior Publication Data

US 2010/0044327 A1 Feb. 25, 2010

(30) Foreign Application Priority Data

Jun. 29, 2006 (FR) ..... 06 05899

(51) Int. Cl.
*A47F 7/00* (2006.01)

(52) U.S. Cl. ..... 211/70.6; 211/89.01; 206/376

(58) Field of Classification Search ..... 211/70.6, 211/89.01; 206/372, 376

See application file for complete search history.

(56) References Cited

U.S. PATENT DOCUMENTS

| | | | | | |
|---|---|---|---|---|---|
| 1,967,458 | A * | 7/1934 | Vallone | ..... | 206/376 |
| 2,068,308 | A * | 1/1937 | Zerver | ..... | 206/376 |
| 2,465,290 | A * | 3/1949 | Sorenson | ..... | 206/376 |
| 4,867,332 | A | 9/1989 | Mains | | |
| 4,911,297 | A * | 3/1990 | Suburu | ..... | 206/376 |
| 5,020,666 | A * | 6/1991 | Barlean | ..... | 206/376 |
| 5,964,348 | A * | 10/1999 | Matsuda | ..... | 206/376 |
| 6,257,409 | B1 | 7/2001 | Lin | | |
| 6,305,542 | B1 * | 10/2001 | Barbrow | ..... | 206/376 |
| 7,815,058 | B2 * | 10/2010 | Cheng | ..... | 211/70.6 |
| 2003/0080076 | A1 | 5/2003 | Hu | | |
| 2004/0094444 | A1 | 5/2004 | Chen | | |
| 2005/0098461 | A1 * | 5/2005 | Kao | ..... | 206/372 |

OTHER PUBLICATIONS

International Search Report issued Jun. 12, 2007 in the International (PCT) Application of which the present application is the U.S. National Stage.

* cited by examiner

*Primary Examiner* — Korie Chan

(74) *Attorney, Agent, or Firm* — Wenderoth, Lind & Ponack, L.L.P.

(57) ABSTRACT

A support for a series of tools, each tool including at least one head and one handle, includes a base; a plurality of housings, each housing being intended to receive and retain the handle; a plurality of means for receiving and retaining a head, each receiving and retaining means being intended to receive and retain the head; the housings and the receiving and retaining means being secured to the base, each housing comprising two partitions, at least one of the partitions including a means for positioning the handle. At least one partition, which is formed integrally with the base, is designed to flex elastically and transversely to allow the handle to overcome the means for positioning the handle.

19 Claims, 6 Drawing Sheets

SUPPORT FOR A SET OF TOOLS

BACKGROUND OF THE INVENTION (1) Field of the Invention

The present invention relates to a support for a set of tools, in particular for spanners or ring spanners, each tool comprising at least one operating head and a handle.

(2) Description of the Related Art

Hand tools are generally marketed as a set of tools which are arranged on a support which is subsequently used in workshops to arrange the set of tools and check the presence of all the tools from the set in the support.

From the patent application U.S. Pat. No. 2,068,308, it is known to produce such a wrench support from sheet steel, the support comprising a base from which extends an element for receiving and retaining tool heads and an element which is formed by housings for tool handles, the element which is formed by housings being separate from the base and being fitted thereto.

However, such a configuration is difficult to implement since it requires cutting, folding and crimping and therefore does not allow a hand tool support to be obtained for a low production cost.

BRIEF SUMMARY OF THE INVENTION

The object of the invention is to simplify the configuration of a support for a set of tools whilst reducing the production costs.

To this end, the invention relates to a support for a set of tools of the above-mentioned type, characterised in that at least one partition of each channel, which is integral with the base, is capable of flexing resiliently and transversely in order to allow the handle to pass the means for positioning the handle.

In this manner, the invention provides efficient positioning of the tool handle and allows the production cost of the support to be reduced.

The support is of the type comprising:

a base which is generally substantially planar;

a plurality of mutually parallel housings, each housing being intended to receive and retain the handle of a corresponding tool from the set in a predetermined position in the support;

a plurality of means for receiving and retaining a tool head, each receiving and retaining means being associated with a housing and being intended to receive and retain the operating head of the corresponding tool in a predetermined position in the support;

the plurality of housings and the plurality of receiving and retaining means being fixedly joined to the base, each housing comprising two substantially mutually parallel partitions which delimit a channel, at least one of the partitions comprising a means for positioning the handle.

According to other embodiments:

each partition is arranged substantially perpendicularly relative to the base;

the means for receiving and retaining a tool head are integral with the base;

the means for positioning the handle comprises a protuberance which is arranged so as to protrude transversely into the channel and which is integral with the partition which carries it;

the support is moulded in one piece by means of thermoplastic injection;

the support is moulded from thermoplastic elastomer material;

the support comprises at least one lateral wall, preferably two lateral walls which is/are integral with the base and which delimit(s) externally one or more outer housing(s), each lateral wall connecting the base to the means for receiving and retaining a tool head;

the means for receiving and retaining a tool head define, at one end of the base, a space for receiving the tool head, the end of the base forming a stop for retaining the tool head;

the means for receiving and retaining the tool head comprise a stepped bar which extends substantially perpendicularly relative to the longitudinal direction of the channels, the bar having portions with dimensions which complement those of a female inner shape of the tool heads of the set;

the means for receiving and retaining the tool head comprise a series of stepped receptacles, each receptacle extending in continuation of the associated channel, the series of receptacles having portions with shapes which complement the outer shapes of the tool heads of the set;

each portion is spaced from the base;

the receiving and retaining means have substantially circular cross-sections which increase progressively from one portion to the next;

each means for receiving and retaining a tool head is arranged substantially in the same plane as the associated housing of the corresponding handle of a tool, respectively;

each channel is capable of receiving the handle of an associated tool with play in each direction of the cross-section of the handle.

DETAILED DESCRIPTION OF THE DRAWINGS

The invention and its advantages will be better understood from a reading of the following description, given purely by way of example, and with reference to the appended drawings, in which.

DETAILED DESCRIPTION OF THE INVENTION

Figure 1:
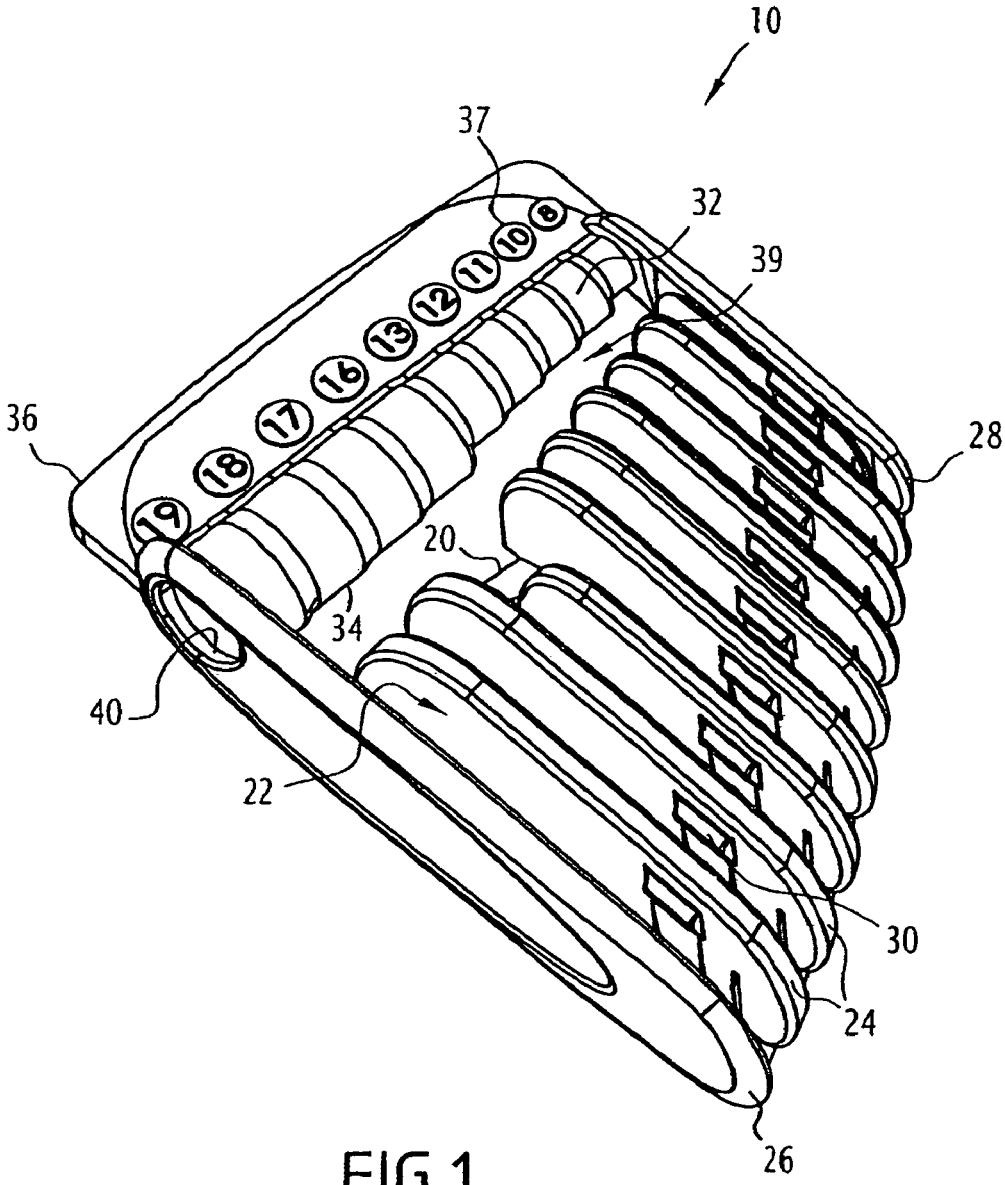
FIG. 1 is a perspective view of a support for a tool set according to the invention.
Figure 2:
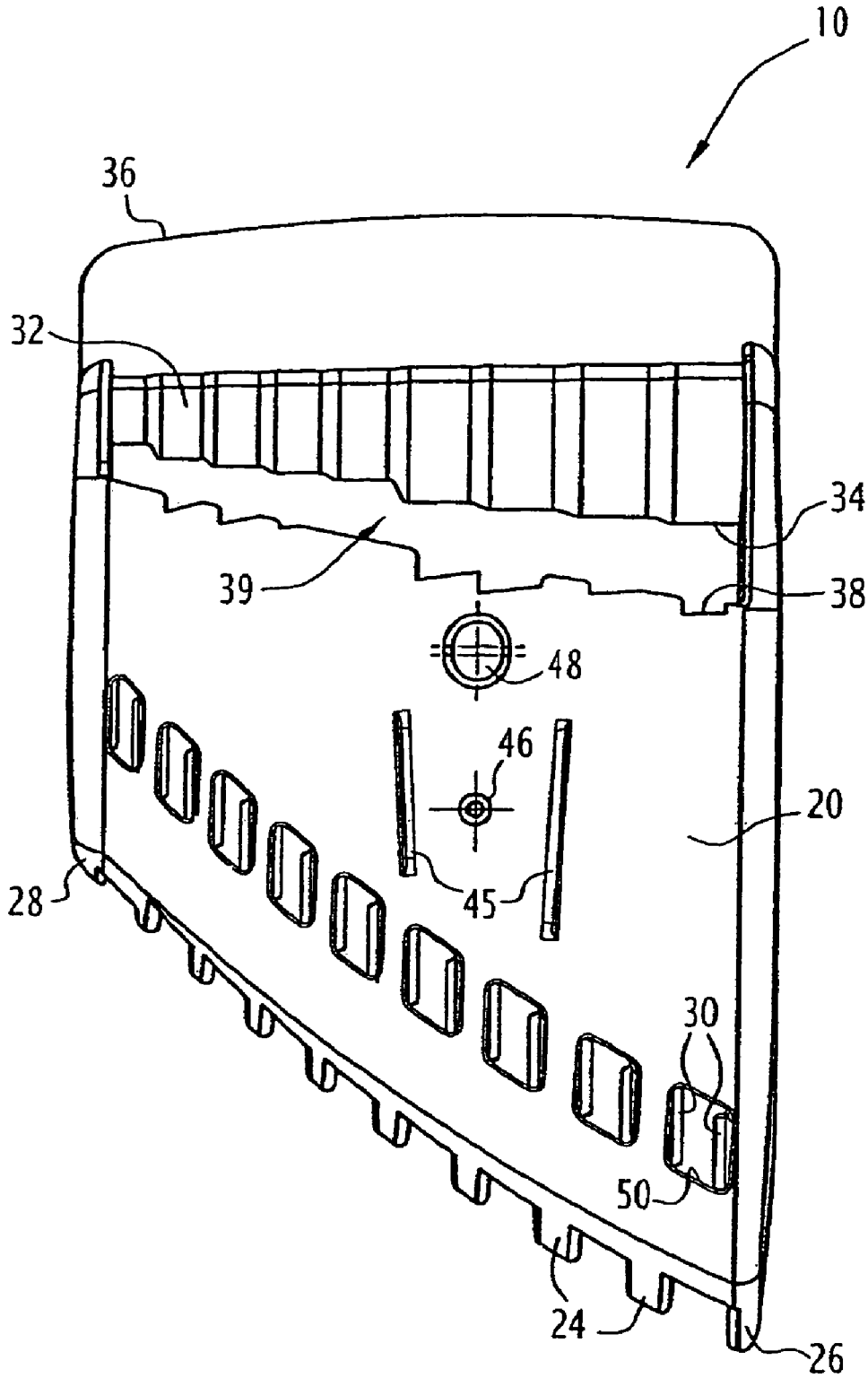
FIG. 2 is a rear view of the support for a tool set illustrated in FIG. 1.
Figure 3:
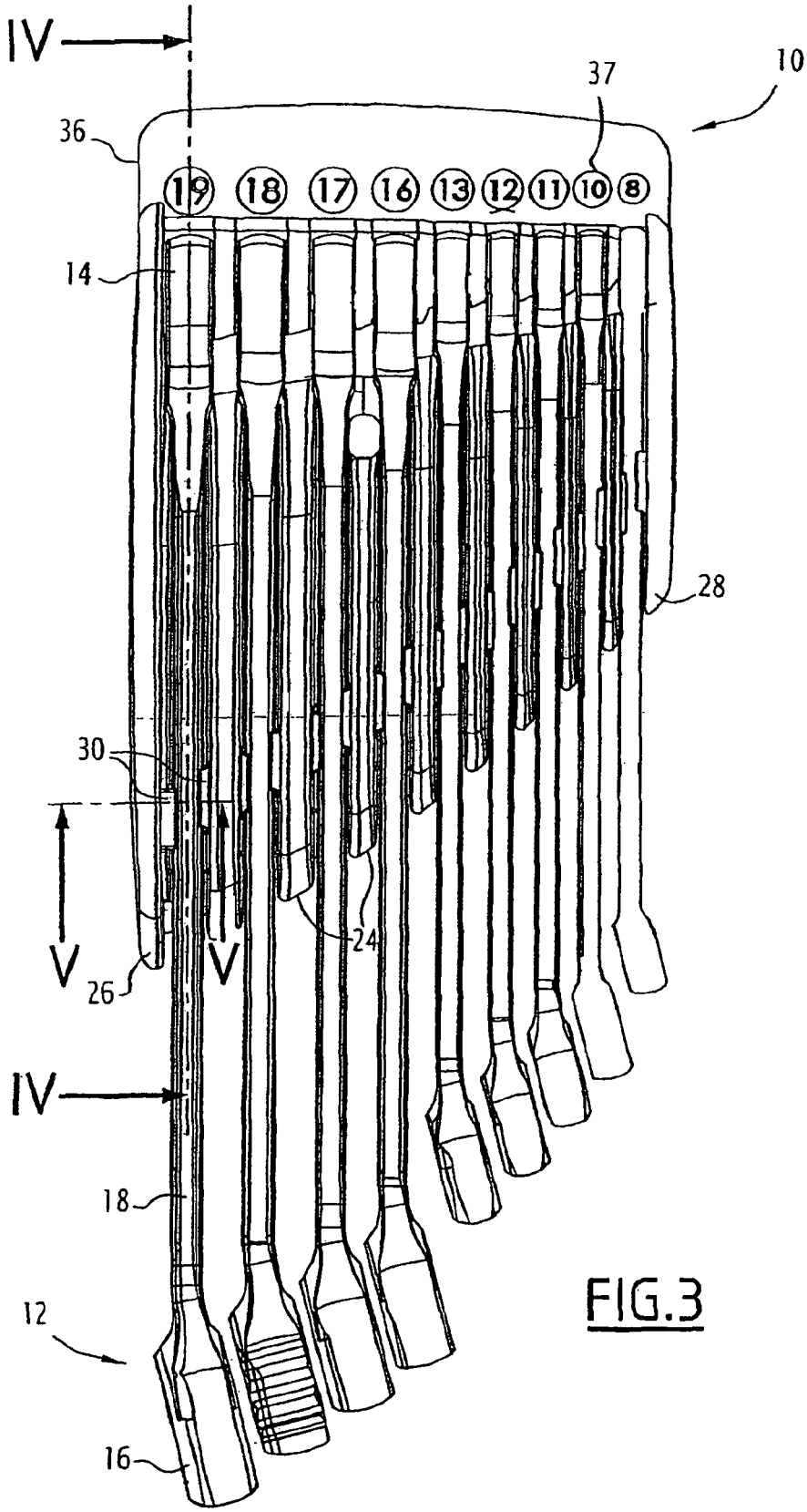
FIG. 3 is a front view of the support for a set of tools illustrated in FIG. 1, the tools being in position on the support.

FIGS. 1 to 5 illustrate a support 10 for a set of tools 12 (FIG. 3), in particular for spanners, each tool comprising at least one operating head 14 and 16 and a handle 18, the head 14 being of the type having an open fork-shaped profile and the head 16 being of the type having a closed ring-shaped profile in the example illustrated in FIG. 3. The support 10 is moulded in one piece by means of thermoplastic injection from a thermoplastic elastomer material, which is, for example, a thermoplastic elastomer having a hardness of between 50 Shore D and 90 Shore D.

The support 10 comprises a base 20 which is generally substantially planar and in the form of a trapezium.

A plurality of housings 22 extend in a mutually parallel manner from the base 20, each housing being intended to receive and retain the handle 18 of a corresponding tool of the set in a predetermined position in the support 10.

A plurality of receiving and retaining means 32 for a tool head 14 extend substantially perpendicularly relative to the housings 22, each receiving and retaining means 32 being associated with a housing 22 and being intended to receive and retain the operating head 14 of the corresponding tool 12 in a predetermined position in the support 10.

The housings 22 and the receiving and retaining means 32 are fixedly joined to the base 20.

The intermediate housings 22 comprise solid partitions 24 which are substantially mutually parallel and which delimit a channel 22. The outer partitions of the two outer housings form an outer lateral wall 26, 28, respectively.

The lateral walls 26 and 28 connect the base 20 to the receiving and retaining means 32 and are arranged in the region of the trapezoidal bases. The wall 28 thus has a longitudinal dimension which is less than that of the wall 26.

The partitions 24 and the two lateral walls 26 and 28 are integral with the base 20, protrude substantially perpendicularly relative to this base, on the same face of the base, and each comprises a means 30 for positioning the handle 18. This means 30 is formed by a protuberance 30 which is integral with the partition 24 and/or the lateral wall 26 or 28 which carries it and is arranged so as to protrude transversely in the channel 22.

The means 32 for receiving and retaining tool heads are also integral with the base 20 and comprise a hollow stepped bar 32 which is generally substantially conical and which extends substantially perpendicularly relative to the longitudinal direction of the channels 22. A portion 34 (i.e. a receiving portion) which is of a size which complements those of the female inner shape 15 of a tool head 14 of the set of tools, defines a step of the bar 32. Each portion 34 is spaced from the base 20 and transversely retains the fork 14 relative to the bar 32.

A step of the bar 32 is arranged substantially in the same plane as the associated housing 22 of the handle 18 of the corresponding tool 12 and the bar 32 has cross-sections which increase progressively from one portion 34 to the following portion.

A protruding tongue 36 extends the stepped bar 32 in the longitudinal direction of the channels 22. A mark 37 which is integral with the tongue 36 is arranged facing each portion 34 of the stepped bar 32. Each mark 37 indicates the opening dimension of the female inner profile 15 of the head 14 of the tool 12.

The base 20 further comprises a tapered end 38 which is directed towards the bar 32 and spaced therefrom by a space 39 for receiving the tool head 14, as will be described below.

The hollow bar 32 opens in each of the lateral walls 26 and 28, respectively, in the region of holes 40 and 42 (FIG. 4), respectively.

A metal clamp 44 (FIG. 4) which is positioned between two ribs 45 of the rear face of the base 20 (FIG. 2) is fitted and fixed by a fixing element (not illustrated) which is itself screwed into a blind hole 46. The clamp 44 allows the support to be hooked to the belt of a user.

An aperture 48 is provided in continuation of one of the partitions 24, and is sized in such a manner that a rod of a sales display packaging may extend from one side of the base 20 to the other. In this manner, the support 10 contributes to the sales packaging of the set of tools.

Figure 4:
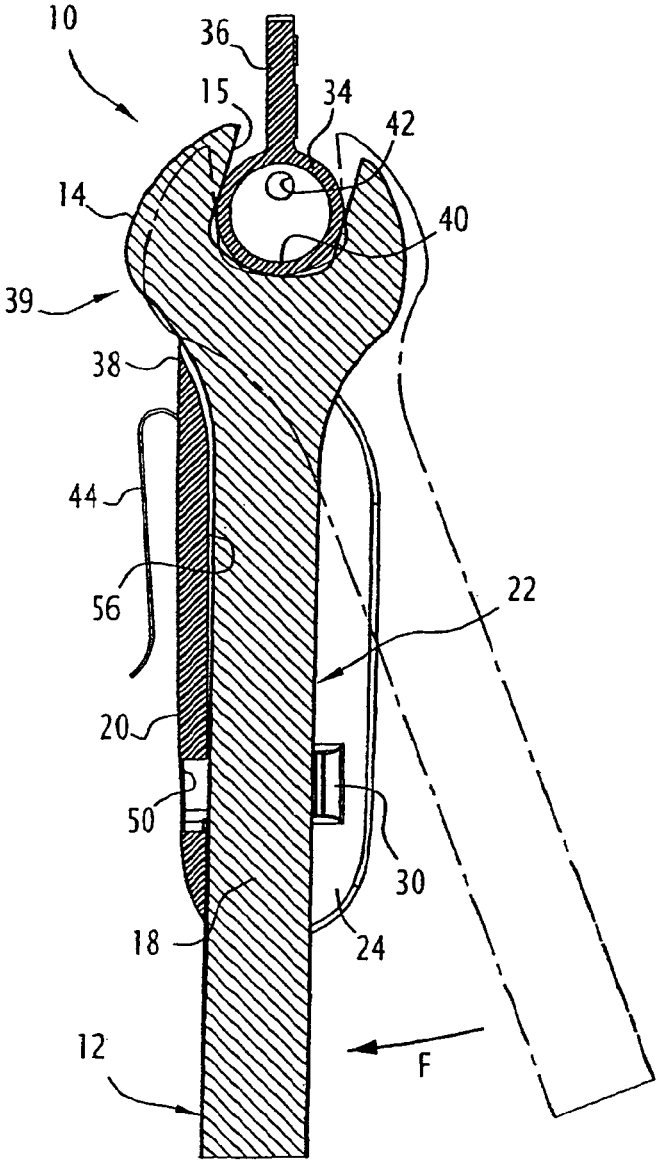
FIG. 4 is a section along the line IV-IV of FIG. 3.
Figure 5:
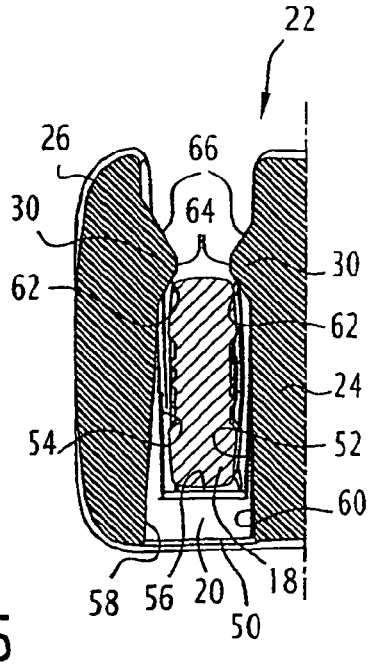
FIG. 5 is an enlarged sectional view along the line V-V of FIG. 3.

As illustrated more specifically in FIGS. 2, 4 and 5, apertures 50 which are produced in the base 20 opposite the positioning protuberances 30 which protrude transversely in the channels 22, during thermoplastic injection, allow rods to pass through which allow a portion of each protuberance 30 to be moulded.

FIG. 5 is a cross-section drawn to an enlarged scale relating to the zone of the protuberances 30. It illustrates an outer channel 22 in which a tool handle 18 is inserted. A first protuberance 30 protrudes transversely in the channel 22 from the lateral wall 26. A second protuberance 30 protrudes in the channel 22 from the partition 24. Two surfaces 52 and 54 laterally delimit the channel 22, the base 20 delimiting the base surface 56 of the channel 22. The surfaces 52 and 54 have a slight relief in order to allow removal from the mould during thermoplastic injection.

In the continuation of the aperture 50, two surfaces 58 and 60 which are substantially planar and which have an inverted relief relative to the surfaces 52 and 54 extend respectively beyond one half of the height of the lateral wall 26 and the partition 24 in the direction of the free end of the same lateral wall and partition. An inclined surface 62 extends each of the surfaces 58 and 60, respectively, the surfaces 62 converging towards the centre of the channel. Two planar and parallel surfaces 64 extend, in the longitudinal axis of the channel 22, each of the inclined surfaces 62 in the direction of the free end of the wall 26 and the partition 24, respectively. Still in the direction of the free end of the lateral wall 26 and the partition 24, an inclined surface 66 extends each of the planar surfaces 64, respectively, the surfaces 66 diverging relative to the centre of the channel in the direction of the free end of the lateral wall 26 and the partition 24.

The surfaces 62, 64 and 66 form retention, connection and entry surfaces for the protuberances 30, respectively. The distance between the connection surfaces 64 is less than the smallest dimension of the cross-section of the handle 18, so that the retention surfaces 62 are capable of retaining the handle of the tool.

With reference to FIG. 4, the positioning of a spanner 12 will now be described. This Figure illustrates, with dot-dash lines, a first step for positioning a spanner 12 on the tool support 10. The fork 14 of the tool 12 is presented with respect to the portion 34 corresponding to the opening dimension of the female inner profile 15 of the tool 12, so that the fork 14 overlaps the associated portion 34.

One of the jaws of the fork 14 is introduced into the receiving space 39 which separates the base 20 from the bar 32, the inner profile 15 being adapted to the portion 34 of the bar 32 which is of a complementary size.

The handle 18 forms an angle with the longitudinal direction of the channel 22 of the support 10. Since the cross-section of the portion 34 is substantially circular, the wrench 12 is capable of rotating about a centre of rotation defined by the centre of the cross-section of the portion 34 which is covered by the fork 14. In a rotation movement which has a tendency to move the handle 18 towards the channel 22 (arrow F in FIG. 4), the operator engages the handle 18 therein and places the handle 18 in contact with the inclined entry surfaces 66 of the protuberance 30. Under the action of the forward movement of the handle 18 and owing to the resilience of the partition 24 and/or the wall 26, the entry surfaces 66 move apart, taking with them the connection surfaces 64 on which the handle 18 slides. The partitions 24 and the lateral walls 26 and 28 are capable of flexing resiliently and transversely in order to allow the handle 18 to pass the positioning protuberances 30 of this handle.

After passing the connection surfaces 64 of the protuberances 30, the handle 18 abuts the base 56 of the channel 22 and the retaining surfaces 62 retain the handle 18 in the associated housing 22 with play.

Each channel 22 has a width which is slightly greater than the smallest dimension of the handle 18 of the associated tool 12. Consequently, the partition 24 and the lateral wall 26 flex resiliently, from their initial unrestricted position, and return, after the handle 18 has passed the positioning protuberances 30, into their initial position, even if the adjacent housings are occupied by other tools. In this manner, the partition 24 and the lateral wall 26 are subject to flexing restrictions only when the handle 18 passes the positioning protuberance 30, which improves the durability of the plastics material over time. Consequently, the handle 18 is retained in its housing with slight play in both directions of its cross-section.

When the handle 18 is in the retention position, the end 38 of the base 20 forms a retention stop for the outer profile of the tool head 14. In this manner, the head 14 is retained transversely by the bar 32 and longitudinally by the stop 38, the stop 38 effectively counteracting the longitudinal translation movement of the tool 12 relative to the channel 22.

In the other embodiments which will now be described, the elements which have the same function as that described above have the same reference numerals increased by 100.

Figure 6:
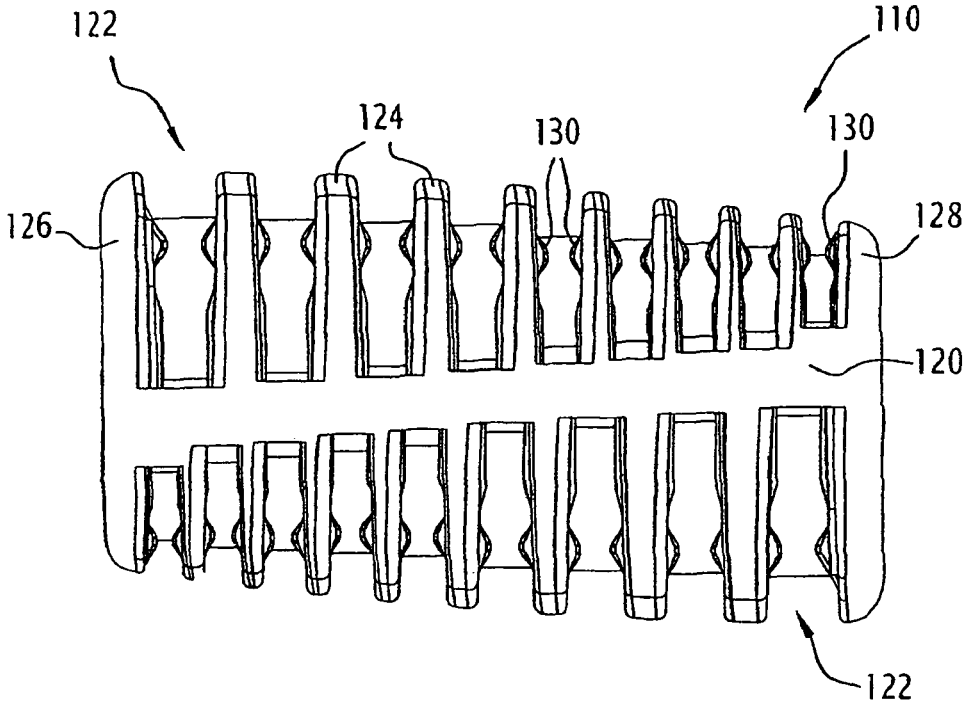
FIG. 6 is a view from below of a second embodiment of a support for a set of tools according to the invention.

A second embodiment, illustrated in FIG. 6, differs from that illustrated in FIGS. 1 to 5 in that the support 110 comprises two sets of parallel housings 122 which are arranged substantially back-to-back and which comprise a common base 120, the assembly being moulded in one piece by means of thermoplastic injection. Two walls 126 and 128 having protuberances 130 laterally delimit the support 110, partitions 124 carrying at each side a protuberance 130 which delimits the channels 122. The support 110, when viewed from below, is generally substantially rectangular with the base 120 extending in an oblique manner from the wall 126 to the wall 128.

Figure 7:
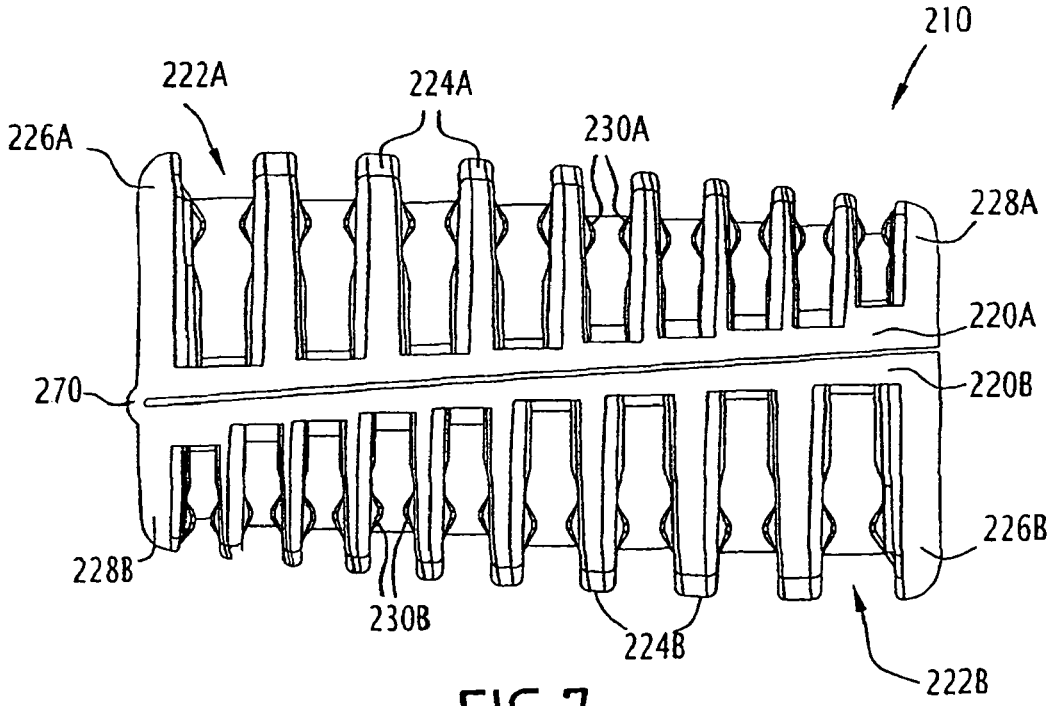
FIG. 7 is a view from below of a third embodiment of a support for a set of tools according to the invention.

A third embodiment of the invention illustrated in FIG. 7 differs from the second embodiment illustrated in FIG. 6 in that the support 210 for a set of tools is in the form of a first set of parallel housings 222A and a second series of parallel housings 222B which are delimited by partitions 224A 224B, respectively, and lateral walls 226A, 228A, 226B, 228B. These partitions and walls are integral with a first base 220A and a second base 220B, respectively. An articulation 270 which is in particular integral with the bases 220A and 220B allows the support 210 to be opened in the manner of a wallet so as to present the tools at the same face, whilst ensuring that the means for storing the tools is as compact as in the second embodiment. In an embodiment which is not illustrated, the integral hinge 270 is replaced by a conventional hinge in which the two supports comprise complementary pins which fit one inside the other, a shaft extending through the pins in order to fix and articulate the two supports to each other.

Figure 8:
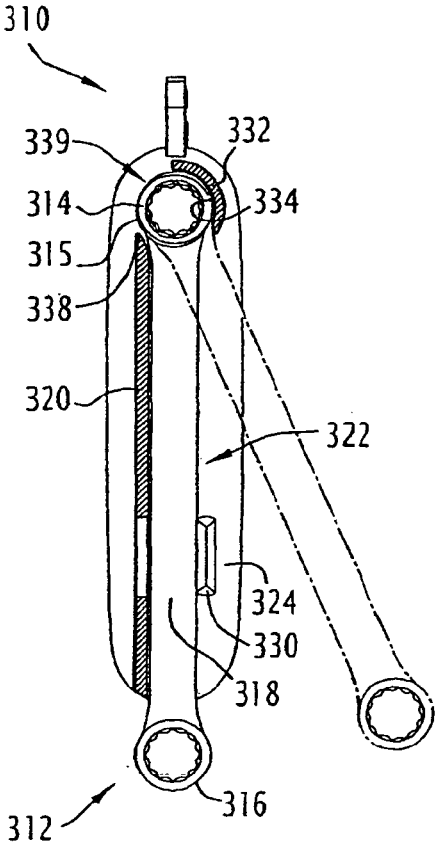
FIG. 8 is a section of a fourth embodiment of a support for a set of tools according to the invention.

A fourth embodiment illustrated in FIG. 8 differs from the first embodiment illustrated in FIG. 4, in that the tool support 310 is capable of receiving and retaining ring spanners 312, the heads 314 and 316 having a closed ring shaped profile. The means 332 for receiving and retaining the tool head 314 comprise a series of stepped receptacles, each receptacle 332 extending in continuation of the associated channel 322. Each receptacle 332 has a portion 334 in the form of an arc of a circle, having a shape which complements the outer shape 315 of the head 314 of the corresponding tool 312 with a closed profile. In this embodiment, as in the first embodiment, each portion 334 is spaced from the base 320. The means 332 for receiving and retaining the tool head 314 define, at one end 338 of the base 320, a space 339 for receiving the tool head 314. The outer profile 315 of the head 314 engaged in the receiving space 339 moves into abutment against the end 338 of the base 320. In this manner, the end 338 of the base 320 forms a longitudinal stop for retaining the head 314, which acts counter to the longitudinal translation movement of the tool 312 relative to the associated channel 322.

As illustrated in FIG. 8, the receptacle 334 has a passage between the end 338 of the base 320 and the front free end of the receptacle 334. This passage constitutes approximately 110° of the outer circumference of the head 314 and therefore has a dimension which is slightly less than the outer diameter 315 of the head 314. In this manner, the head is received in the receptacle 334 by means of resilient deformation of the free end of the receptacle 334.

In an embodiment which is not illustrated, the receptacle 334 is connected at the rear to the end 338 of the base 320 and has a shape which complements that of the outer surface 315 of the head 314 of the tool 312, whilst retaining the characteristic of the stop 338.

Figure 9:
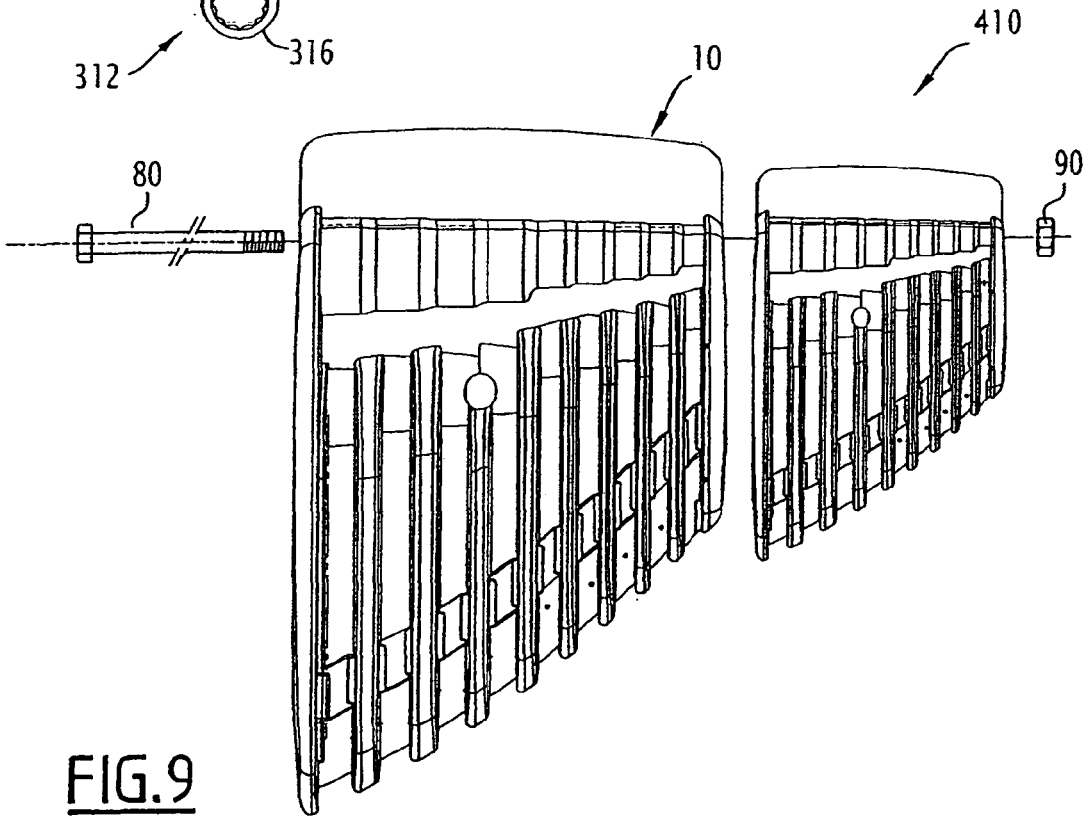
FIG. 9 is a front view illustrating the mechanical assembly of two supports for a set of tools according to the invention.

FIG. 9 illustrates a method for mechanical assembly of a first support 10 and a second support 410 of the type similar to that of the first embodiment, that is to say, of the type having a stepped hollow bar which opens in the region of each of the lateral walls via a hole, respectively, the supports 10 and 410 being capable of receiving and retaining tools of different sizes. A threaded rod 80 is engaged through each of the hollow bars of the first and second supports via the holes which are arranged in the region of each of the lateral walls of each of the supports, then a nut 90 is screwed to the end of the threaded rod which extends past the second support. In this manner, two supports of the same type are fixed beside each other, the threaded rod itself being able to be connected to a support for an item of storage furniture.

Produced in one piece from thermoplastic material, the support according to the invention has rounded shapes which are therefore harmless for an operator, in contrast to the prior art defined above. In this manner, the support according to the invention has improved characteristics in terms of ergonomics.

Furthermore, the design of the partitions and lateral walls of each channel, which are integral with the base, allows the handle to be retained with slight play in a predetermined position in the support without subjecting the portions of the partitions or walls which flex to continuous mechanical stresses, thus improving the long term durability of the support whilst ensuring a low production cost.

The invention claimed is:

1. A support for a set of wrenches, each wrench comprising an operating head and a handle having a longitudinal direction and a transverse cross section having a larger dimension and a smaller dimension, said support comprising:

a base which is generally substantially planar;

a plurality of mutually parallel housings, each housing being configured to receive and retain the handle of a corresponding wrench from the set in a predetermined position in said support;

a plurality of receiving portions for receiving and retaining the operating head of the corresponding wrench in a transverse direction perpendicular to the longitudinal direction, each receiving portion being associated with a housing and being configured to receive and retain the operating head of the corresponding wrench in a predetermined position in said support;

wherein said plurality of housings and said plurality of receiving portions are fixedly joined to said base, wherein each housing comprises two substantially mutually parallel partitions which delimit a channel, at least one of said partitions comprising a protuberance for positioning the handle, wherein each channel has a width which is slightly greater than the smaller dimension of the handle of the corresponding wrench, wherein said base comprises a retention stop against which the operating head of each wrench is in abutment when the operating head is in the predetermined position, and wherein said retention stop retains the operating head of each wrench in the longitudinal direction when the operating head is in the predetermined position, and said plurality of receiving portions retains the operating head of each wrench in the transverse direction and the longitudinal direction when the operating head is in the predetermined position.

2. The support of claim 1, wherein at least one partition of each channel is integral with said base and is capable of flexing resiliently and transversely in order to allow the handle to pass the respective protuberance.

3. The support of claim 1, wherein each partition is arranged substantially perpendicularly relative to said base.

4. The support of claim 1, wherein said receiving portions are integral with said base.

5. The support of claim 1, wherein each of said protuberances is arranged so as to protrude transversely into the respective channel and is integral with the partition which carries it.

6. The support of claim 1, wherein said support is moulded in one piece by thermoplastic injection.

7. The support of claim 6, wherein said support is moulded from thermoplastic elastomer material.

8. The support of claim 1, further comprising a lateral wall which is integral with said base and delimits an outer housing, said lateral wall connecting said base to said plurality of receiving portions.

9. The support of claim 1, wherein said support comprises two lateral walls which are integral with said base and delimit two outer housings, said lateral walls connecting said base to said plurality of receiving portions.

10. The support of claim 1, wherein said plurality of receiving portions defines, at one end of said base, a space for receiving the operating head.

11. The support of claim 1, wherein said plurality of receiving portions comprises a stepped bar which extends substantially perpendicularly relative to the longitudinal direction of said channels, said stepped bar having portions with dimensions which complement those of a female inner shape of the operating heads of the set of wrenches.

12. The support of claim 11, wherein each portion of said stepped bar is spaced from said base.

13. The support of claim 12, wherein said receiving portions have substantially circular cross-sections which increase progressively from one portion to the next.

14. The support of claim 1, wherein said plurality of receiving portions comprises a series of stepped receptacles, each receptacle extending in continuation of the associated channel, said series of receptacles having portions with shapes which complement the outer shapes of the operating heads of the set of wrenches.

15. The support of claim 14, wherein each portion of said receptacles is spaced from said base.

16. The support of claim 15, wherein said receiving portions have substantially circular cross-sections which increase progressively from one receiving portion to the next.

17. The support of claim 1, wherein each receiving portion is arranged substantially in the same plane as one of said housings such that the operating head of a wrench disposed in the respective housing engages the respective receiving portion.

18. The support of claim 1, wherein each channel is capable of receiving the handle of the associated wrench with play in each direction of the cross-section of the handle.

19. The support of claim 1, wherein said plurality of receiving portions comprises a bar which extends substantially perpendicular to the longitudinal direction of said channels and which engages an inner profile of the operating heads of the wrenches, and wherein said retention stop is an end of said base which is spaced apart from said bar and which engages an outer profile of the operating heads of the wrenches.

* * * * *